US011830690B2

(12) United States Patent
Kim

(10) Patent No.: US 11,830,690 B2
(45) Date of Patent: Nov. 28, 2023

(54) ARC-EXTINGUISHING UNIT STRUCTURE FOR DIRECT CURRENT AIR CIRCUIT BREAKER

(71) Applicant: LS ELECTRIC CO., LTD., Anyang-si (KR)

(72) Inventor: Il-Hyun Kim, Anyang-si (KR)

(73) Assignee: LS ELECTRIC CO., LTD., Anyang-si (KR)

( * ) Notice: Subject to any disclaimer, the term of this patent is extended or adjusted under 35 U.S.C. 154(b) by 171 days.

(21) Appl. No.: 17/601,578

(22) PCT Filed: Mar. 11, 2020

(86) PCT No.: PCT/KR2020/003413

§ 371 (c)(1),
(2) Date: Oct. 5, 2021

(87) PCT Pub. No.: WO2020/204388

PCT Pub. Date: Oct. 8, 2020

(65) Prior Publication Data

US 2022/0208488 A1 Jun. 30, 2022

(30) Foreign Application Priority Data

Apr. 5, 2019 (KR) ..... 10-2019-0039919

(51) Int. Cl.
*H01H 33/53* (2006.01)
*H01H 33/18* (2006.01)

(52) U.S. Cl.
CPC ..... *H01H 33/182* (2013.01); *H01H 33/53* (2013.01)

(58) Field of Classification Search
CPC .... H01H 33/182; H01H 33/187; H01H 33/53; H01H 9/362; H01H 9/30; H01H 9/443; H01H 73/18; H01H 31/02
(Continued)

(56) References Cited

U.S. PATENT DOCUMENTS 8,237,074 B2 * 8/2012 Tetik ..... H01H 9/362 218/156
10,176,945 B2 * 1/2019 Domejean ..... H01H 77/108
(Continued)

FOREIGN PATENT DOCUMENTS

CN 104157524 A 11/2014
CN 207319963 * 5/2018 ..... H01H 9/443
(Continued)

OTHER PUBLICATIONS

Translation of KR1020180048151 (Original document published May 10, 2018) (Year: 2018).*
(Continued)

*Primary Examiner* — William A Bolton
(74) *Attorney, Agent, or Firm* — K&L Gates LLP

(57) ABSTRACT

An arc-extinguishing unit structure for a direct current air circuit breaker according to one embodiment of the present disclosure comprises: a plurality of grids; side plates coupled to both sides of the plurality of grids so that the plurality of the grids are mounted so as to be spaced apart from each other; an exhaust cover positioned above the side plates and the plurality of grids; an arc guide coupled to the side plates so as to be located under the plurality of grids; a magnet coupled to the arc guide, wherein the magnet is magnetized with different poles on the basis of the plurality of grids and the vertical orientation of the arc guide.

17 Claims, 8 Drawing Sheets

(58) Field of Classification Search
USPC ..... 218/22, 23, 26, 34, 36, 38, 40, 81
See application file for complete search history.

(56) References Cited

U.S. PATENT DOCUMENTS

| | | | | |
|---|---|---|---|---|
| 10,192,700 | B2 * | 1/2019 | Rival | H01H 33/10 |
| 2011/0297649 | A1 | 12/2011 | An | |
| 2013/0075367 | A1 * | 3/2013 | Eriksson | H01H 33/08 218/34 |
| 2013/0284702 | A1 | 10/2013 | Hamada et al. | |
| 2014/0319099 | A1 * | 10/2014 | Baujan | H01H 33/08 218/41 |
| 2014/0339196 | A1 | 11/2014 | Seo | |
| 2014/0347151 | A1 * | 11/2014 | Gerving | H01H 9/443 335/205 |
| 2017/0162348 | A1 | 6/2017 | Zhou et al. | |

FOREIGN PATENT DOCUMENTS

| | | | |
|---|---|---|---|
| EP | 2431989 | A1 | 3/2012 |
| EP | 2804190 | A1 | 11/2014 |
| JP | S63129932 | A | 6/1988 |
| JP | H1063043 | U | 4/1989 |
| JP | 2014183028 | A | 9/2014 |
| JP | 2014225452 | A | 12/2014 |
| JP | 2016033890 | A | 3/2016 |
| KR | 20140012034 | A | 1/2014 |
| KR | 20140036960 | A | 3/2014 |
| KR | 20180048151 | A | 5/2018 |

OTHER PUBLICATIONS

Translation of JP2014183028 (Original document published Sep. 29, 2014) (Year: 2014).*
Translation of CN207319963 (Original document published Apr. 5, 2018) (Year: 2018).*
European Search Report for related European Application No. 20782115.8; action dated Apr. 25, 2022; (8 pages).
Office Action for related Japanese Application No. 2021-559217; action dated Nov. 1, 2022; (4 pages).
International Search Report for related International Application No. PCT/KR2020/003413; report dated Oct. 8, 2020; (5 pages).
Written Opinion for related International Application No. PCT/KR2020/003413; report dated Oct. 8, 2020; (11 pages).
Notice of Allowance for related Japanese Application No. 2021-559217; action dated May 23, 2023; (3 pages).

* cited by examiner

ARC-EXTINGUISHING UNIT STRUCTURE FOR DIRECT CURRENT AIR CIRCUIT BREAKER

CROSS-REFERENCE TO RELATED APPLICATIONS

This application is the National Stage filing under 35 U.S.C. 371 of International Application No. PCT/KR2020/003413, filed on Mar. 11, 2020, which claims the benefit of earlier filing date and right of priority to Korea utility model Application No. 10-2019-0039919 filed on Apr. 5, 2019, the contents of which are all hereby incorporated by reference herein in their entirety.

FIELD

The present disclosure relates to an arc-extinguishing structure for a direct-current air circuit breaker.

BACKGROUND

In general, an air circuit breaker (ACB) is installed in a low voltage distribution line and performs transmission, switching, switching, and stop of low voltage system power in a planned manner, and uses air as extinguishing medium to break a circuit in an event of abnormalities such as overcurrent, short circuit and ground fault and thus protect people and a load.

More specifically, a direct-current air circuit breaker according to a prior art includes an extinguishing part and an electrical conducting part inside the circuit breaker. When abnormal current occurs due to overcurrent, short circuit, or ground fault of a line, a mechanical part operates via a relay such that a fixed contact and a movable contact are removed from each other.

Further, an arc is generated when the fixed contact and the movable contact are removed from each other. Accordingly, the arc as generated travels from the fixed contact and the movable contact to a cooling plate via a Lorentz force (an arc magnetic field-based driving force) generated orthogonally by arc current and a magnetic flux density and is cooled and extinguished by the cooling plate.

Further, an arc guide is coupled to an arc chute assay, and the arc guide serves to guide the arc to a center of the cooling plate so that arc extinguishing occurs quickly.

However, in an event of interruption of a small current based on IEC 60947-3 ANNEX D standard, a very small magnetic field-based driving force is generated from the arc due to the small current and magnetic field. Further, arc stagnation occurs between the fixed contact and the movable contact.

Further, high temperature arc stagnation causes serious structural and electrical damage to the extinguishing part and the conducting part, and thus causes deterioration of performance of the breaker and equipment accidents.

SUMMARY

One aspect of the present disclosure has a purpose to provide an arc-extinguishing structure for a direct-current air circuit breaker that generates an arc magnetic field-based driving force using a magnetic field of a magnet, and quickly discharges the arc to an extinguishing unit.

Another aspect of the present disclosure has a purpose to provide an arc-extinguishing structure for a direct-current air circuit breaker in which upper and lower portions of a magnet have different poles in a vertical direction in which the arc guide is positioned below a grid in an arc chute assay, thereby preventing reverse flow of the arc.

Another aspect of the present disclosure has a purpose to provide an arc-extinguishing structure for a direct-current air circuit breaker that may maximize a magnetic field magnitude of the magnet inserted into the arc guide to maximize an arc magnetic field-based driving force.

Another aspect of the present disclosure has a purpose to provide an arc-extinguishing structure for a direct-current air circuit breaker that may secure small current interruption performance while shortening an arc duration.

An arc-extinguishing structure for a direct-current air circuit breaker according to one embodiment of the present disclosure includes a plurality of grids; both opposing side plates respectively coupled to both opposing sides of each of the plurality of grids so that the plurality of the grids are arranged horizontally and spaced from each other; a discharge cover positioned on tops of the side plates and the plurality of grids; each arc guide coupled to each of the side plates such that the guide is positioned below the plurality of grids; and each magnet coupled to each arc guide, wherein the magnet had upper and lower portions in a vertical arrangement of the plurality of grids and the arc guide, wherein the upper and lower portions have different poles.

In one implementation of the arc-extinguishing structure, each magnet receiving groove is defined in the arc guide, wherein the magnet is received in the groove, wherein the magnet extends in the arrangement direction of the grids, wherein the magnet receiving groove extends in the arrangement direction of the grids.

In one implementation of the arc-extinguishing structure, side plate fixing means is defined in the arc guide in an area of the magnet receiving groove, wherein arc guide fixing means corresponding to the side plate fixing means is defined in the side plate.

In one implementation of the arc-extinguishing structure, each of the side plate fixing means and the arc guide fixing means is embodied as a through-hole.

In one implementation of the arc-extinguishing structure, the magnet extends in a longitudinal direction of the arc guide, and a mounting hole corresponding to the through-hole is defined in the magnet, wherein a fastener fastens the arc guide fixing means, the mounting hole, and the side plate fixing means to each other, wherein the fastener fastens the arc guide to the side plate while the magnet is received in the magnet receiving groove.

In one implementation of the arc-extinguishing structure, an upper portion of the magnet is magnetized as a S pole and a lower portion thereof is magnetized as an N pole.

In one implementation of the arc-extinguishing structure, the guide plate of the arc guide in which the magnet receiving groove is defined is formed such that a dimension of one side of the guide plate is larger than a dimension of an opposite side thereof, wherein a dimension of one side of the magnet receiving groove is larger than a dimension of an opposite side thereof, wherein a dimension of one side of the magnet coupled to the magnet receiving hole is larger than a dimension of an opposite side thereof.

In one implementation of the arc-extinguishing structure, the magnet includes a plurality of magnets, wherein the arc guide has a plurality of magnet receiving grooves for receiving the plurality of the magnets, wherein side plate fixing means is defined in the arc guide in an area of each of the magnet receiving grooves, wherein arc guide fixing means corresponding to the side plate fixing means is defined in the side plate.

In one implementation of the arc-extinguishing structure, each of the side plate fixing means and the arc guide fixing means is embodied as a through-hole.

In one implementation of the arc-extinguishing structure, a fastener fastens the arc guide fixing means and the side plate fixing means to each other, wherein the fastener fastens the arc guide to the side plate while the magnet is received in the magnet receiving groove.

In one implementation of the arc-extinguishing structure, an upper portion of each magnet is magnetized as a S pole and a lower portion thereof is magnetized as an N pole.

In one implementation of the arc-extinguishing structure, the arc guide extends in a longitudinal direction from one side to an opposite side thereof and, further, extends downwards from one side, wherein the magnet receiving groove includes a first magnet receiving groove extending downwards from one side of the arc guide, and a second magnet receiving groove extending from one side of the arc guide to the opposite side thereof, wherein the magnet includes a first magnet extending downwards in a corresponding manner to the first magnet receiving groove, and a second magnet extending in the longitudinal direction in a corresponding manner to the second magnet receiving groove.

In one implementation of the arc-extinguishing structure, the grid has a downwardly-inclined portion at a bottom of the grid, wherein the downwardly-inclined portion has an inner side face inclined outwardly as the portion extends from a center toward each of both opposing ends, wherein the arc guide further includes a guide plate having an upwardly-inclined portion facing toward the downwardly-inclined portion.

According to the present disclosure, the arc magnetic field-based driving force may be generated by the magnetic field of the magnet, and thus, the arc may be quickly discharged to the extinguishing structure. According to another aspect of the present disclosure, the upper and lower portions of the magnet have different poles in a vertical direction in which the arc guide is positioned below a grid in an arc chute assay, thereby preventing reverse flow of the arc. Further, the arc-extinguishing structure may maximize a magnetic field magnitude of the magnet inserted into the arc guide to maximize the arc magnetic field-based driving force. Further, the arc-extinguishing structure may secure small current interruption performance while shortening an arc duration.

DETAILED DESCRIPTION

Figure 1:
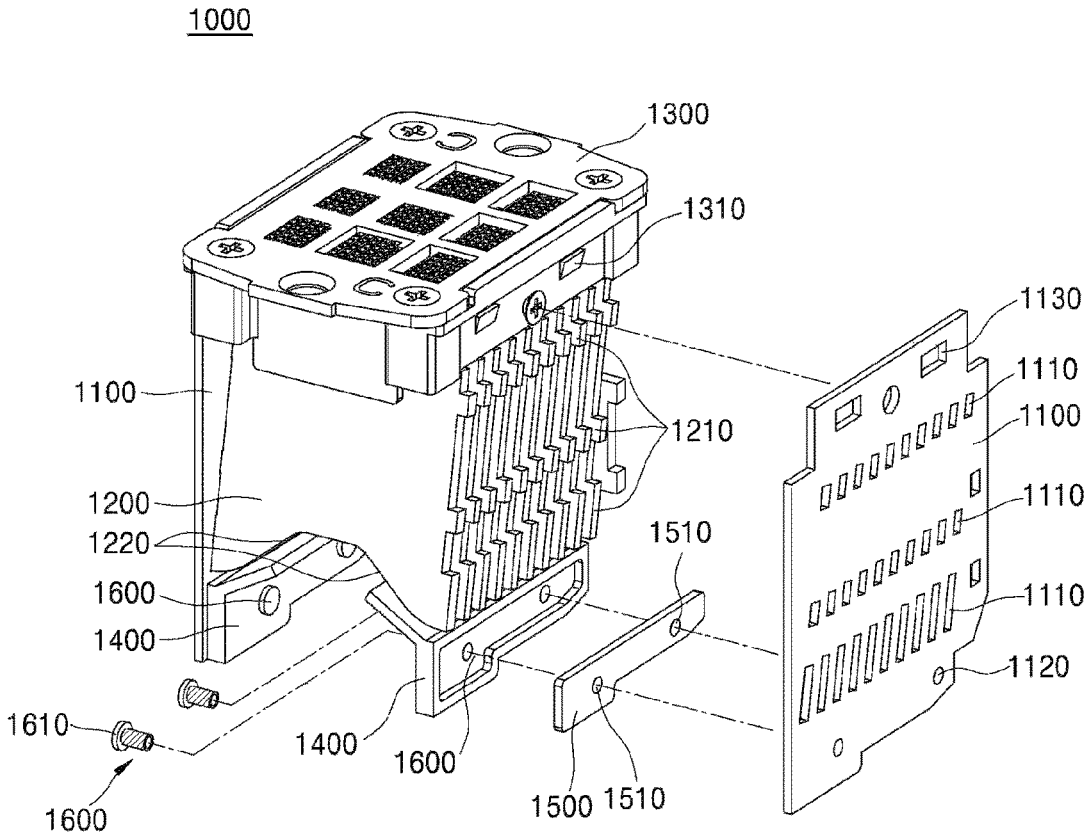
FIG. 1 is a configuration diagram schematically showing an arc-extinguishing structure for a direct-current air circuit breaker according to a first embodiment of the present disclosure.
Figure 2:
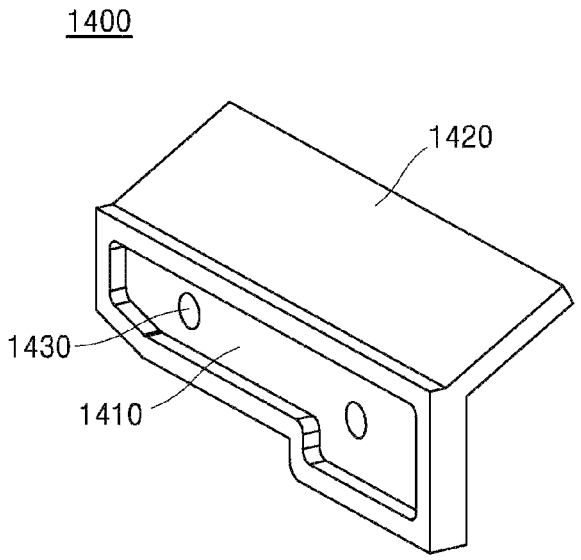
FIG. 2 is a schematic diagram showing an arc guide in the arc-extinguishing structure shown in FIG. 1.
Figure 3:
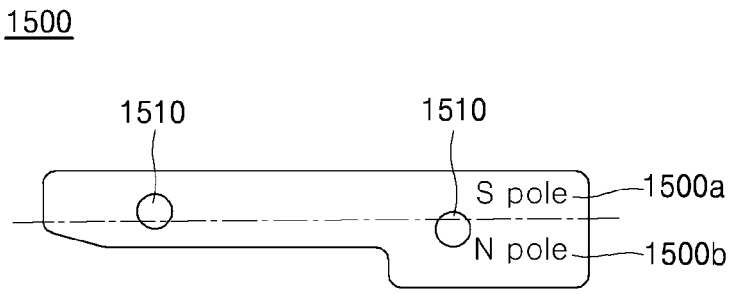
FIG. 3 is a schematic diagram showing a magnet in the arc-extinguishing structure shown in FIG. 1.

FIG. 1 is a configuration diagram schematically showing an arc-extinguishing structure for a direct-current air circuit breaker according to a first embodiment of the present disclosure. FIG. 2 is a schematic diagram showing an arc guide in the arc-extinguishing structure shown in FIG. 1. FIG. 3 is a schematic diagram showing a magnet in the arc-extinguishing structure shown in FIG. 1.

An arc-extinguishing structure 1000 may allow a direct-current air circuit breaker used in various direct-current interruption facilities including solar power generation facilities to secure small current interruption performance.

As shown, the arc-extinguishing structure 1000 includes side plates 1100, a grid 1200, a discharge cover 1300, an arc guide 1400 and a magnet 1500.

More specifically, the grid 1200 acts as a cooling plate that divides and cools incoming arc. The grid 1200 includes a plurality of grids spaced apart from each other and disposed between both opposing side plates 1100 positioned at both opposing sides of the discharge cover 1300.

For this purpose, a fixing protrusion 1210 is formed on each of both opposing ends of the grid 1200, and a through-hole 1110 corresponding to the fixing protrusion 1210 is formed in each side plate 1100.

The grid 1200 has a downwardly inclined portion 1220 so that a lower portion thereof extends from a center toward each of both opposing ends in an inclined manner.

The discharge cover 1300 is coupled to a top of each of the side plates 1100, and the arc guide 1400 is coupled to a bottom of each of the side plates 1100.

To this end, arc guide fixing means 1120 and discharge cover coupling means 1130 are formed in each of the side plates 1100.

The discharge cover 1300 is positioned on tops of the side plates 1100 and the plurality of grids. Side plate coupling means 1310 corresponding to the discharge cover coupling means 1130 of the side plate is formed on the discharge cover 1300.

FIG. 1 shows an example in which the side plate coupling means 1310 is embodied as a protrusion, and the discharge cover coupling means 1130 is embodied as a through-hole.

The arc guide 1400 is fixed to the side plate so as to be positioned under the plurality of grids 1200.

Further, the arc guide 1400 includes a magnet receiving groove 1410, a guide plate 1420 and side plate fixing means 1430. The magnet receiving groove 1410 has a shape corresponding to that of the magnet 1500.

Further, the magnet receiving groove 1410 extends in the arrangement direction of the grids 1200, and the guide plate 1420 extends toward the grid 1200.

The side plate fixing means 1430 may be formed in the magnet receiving groove 1410.

The guide plate 1420 may be embodied as an upwardly inclined portion corresponding to the downwardly inclined portion 1220 of the grid 1200.

The side plate fixing means 1430 is constructed for fixing the arc guide 1400 to the side plate 1100, and corresponds to the arc guide fixing means 1120. Further, each of the arc guide fixing means 1120 and the side plate fixing means 1430 may be embodied as a through-hole.

The magnet 1500 extends in a longitudinal direction of the arc guide 1400 as the arrangement direction of the grids. Different poles are magnetized at upper and lower portions of the magnet in an orthogonal direction to the extension direction, that is, an arrangement direction of the grid 1200 and the arc guide 1400.

In an example, in FIG. 3, the upper portion is magnetized as a S pole as a first pole 1500*a*, and a lower portion is magnetized as a N pole as a second pole 1500*b*.

As described above, as the magnet is mounted and coupled to the arc guide 1400, the magnetic field-based driving force increases to a maximum level, thereby enabling rapid cooling and extinguishing of the arc.

Further, a mounting hole 1510 is formed in the magnet 1500. The mounting hole 1510 is formed to correspond to the side plate fixing means and the arc guide fixing means embodied as the through-hole.

Further, the guide plate of the arc guide 1400 in which the magnet receiving groove 1410 is formed has a dimension of one side thereof which is larger than a dimension of the opposite side thereof. This is based on an overall structure of the arc-extinguishing structure 1000 mounted on the circuit breaker.

Further, the magnet receiving groove 1410 is formed so that a dimension of one side thereof is larger than a dimension of the opposite side thereof in a corresponding manner to the above structure. The magnet 1500 coupled to the magnet receiving hole 1410 is formed so that a dimension of one side thereof is larger than a dimension of the opposite side thereof in a corresponding manner to the above structure.

The arc-extinguishing structure 1000 further includes a fastener 1600. The fastener 1600 combines the arc guide fixing means 1120, the mounting hole 1510 and the side plate fixing means 1430 to each other. Thus, the arc guide may be fixed to the side plate in a state in which the magnet is coupled to the arc guide.

Further, the fastener 1600 may have an insulating layer 1610 made of silicon or the like coated thereon.

Figure 4:
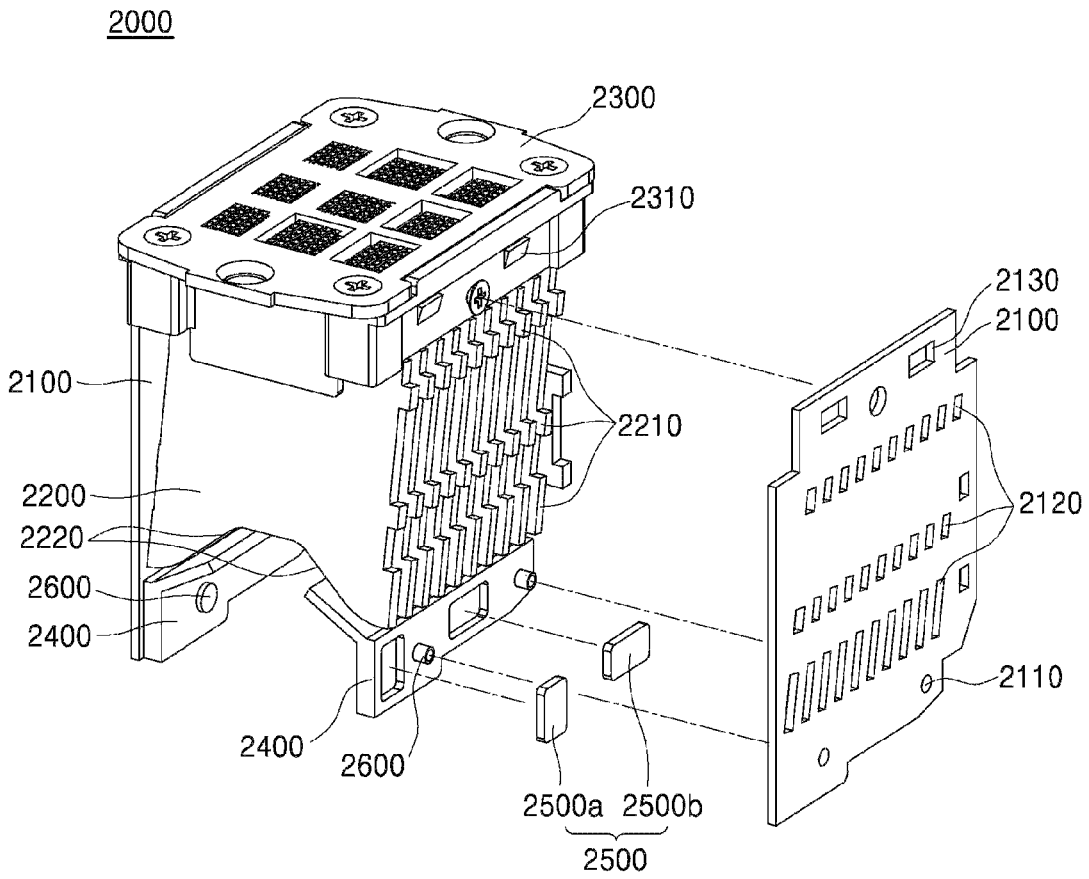
FIG. 4 is a configuration diagram schematically showing an arc-extinguishing structure for a direct-current air circuit breaker according to a second embodiment of the present disclosure.
Figure 5:
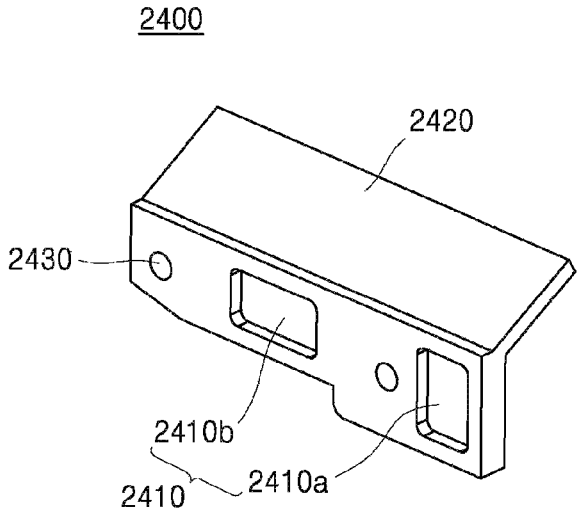
FIG. 5 is a schematic diagram showing an arc guide in the arc-extinguishing structure shown in FIG. 4.
Figure 6:
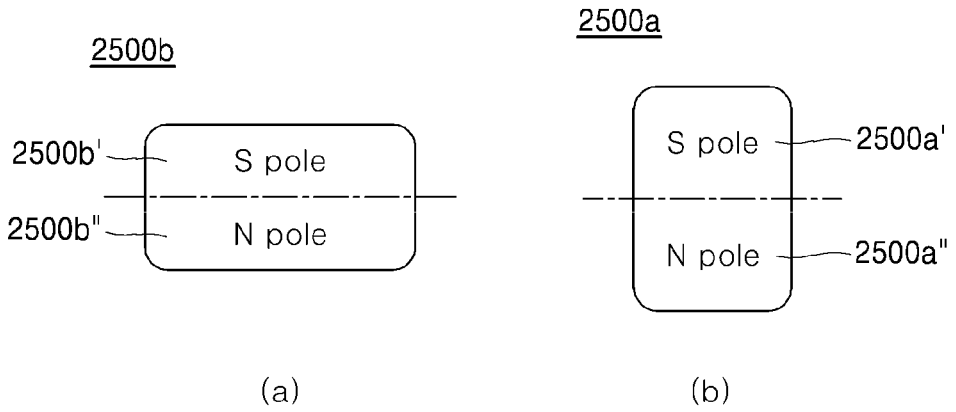
FIG. 6 is a schematic diagram showing a magnet in the arc-extinguishing structure shown in FIG. 4.

FIG. 4 is a configuration diagram schematically showing an arc-extinguishing structure for a direct-current air circuit breaker according to a second embodiment of the present disclosure. FIG. 5 is a schematic diagram showing an arc guide in the arc-extinguishing structure shown in FIG. 4. FIG. 6 is a schematic diagram showing a magnet in the arc-extinguishing structure shown in FIG. 4.

As shown, an arc-extinguishing structure 2000 differs from the arc-extinguishing structure 1000 shown in FIG. 1 to FIG. 3 only in terms of the magnet and the magnet receiving groove 1410 accommodating therein the magnet.

More specifically, the arc-extinguishing structure 2000 includes both side plates 2100, a grid 2200, a discharge cover 2300, an arc guide 2400, and magnets 2500*a* and 2500*b*.

The magnet includes a first magnet 2500*a* and a second magnet 2500*b*.

In addition, the side plates 2100, the grid 2200, and the discharge cover 2300 are respectively identical with the side plates 1100, the grid 2200, and the discharge cover 2300 of the arc-extinguishing structure 1000 according to the first embodiment as described above, and detailed descriptions thereof will be omitted.

The arc guide 2400 has a magnet receiving groove 2410, a guide plate 2420, and side plate fixing means 2430. The magnet receiving groove 2410 includes a first magnet receiving groove 2410*a* into and to which the first magnet 2500*a* is inserted and coupled and a second magnet receiving groove 2410*b* into and to which the second magnet 2500*b* is inserted and coupled.

Further, each of the first magnet receiving groove 2410*a* and the second magnet receiving groove 2410*b* is formed in an area where the side plate fixing means 2430 is not formed.

The arc guide 2400 is formed to extend in the longitudinal direction from one side to the opposite side and at the same time, to extend downward from one side. Accordingly, the arc guide 2400 may have the first magnet receiving groove 2410*a* extending from one side downwardly and the second magnet receiving groove 2410*b* extending from one side to the opposite side.

The first magnet 2500*a* extends downward so as to correspond to the first magnet receiving groove 2410*a*, while the second magnet 2500*b* extends in a longitudinal direction so as to correspond to the second magnet receiving groove 2410*b*.

Upper and lower portions of each of the first magnet 2500*a* and the second magnet 2500*b* are magnetized to have different poles in an orthogonal direction to the extension direction of the arc guide 2400, that is, in an arrangement direction of the grid 2200 and the arc guide 2400.

In an example of FIG. 6, a upper portion of each of the first poles 2500*a*' and 2500*b*' is magnetized as the S pole, while a lower portion of each of the second poles 2500*a*" and 2500*b*" is magnetized as the N pole.

Further, while the first magnet 2500*a* is inserted into the first magnet receiving groove 2410*a*, and the second magnet 2500*b* is inserted into the second magnet receiving groove 2410*b*, the arc guide 2400 is fixed to the side plate 2100 by fastening a fastener 2600 to the arc guide fixing means 2120 and the side plate fixing means 2430.

Figure 7:
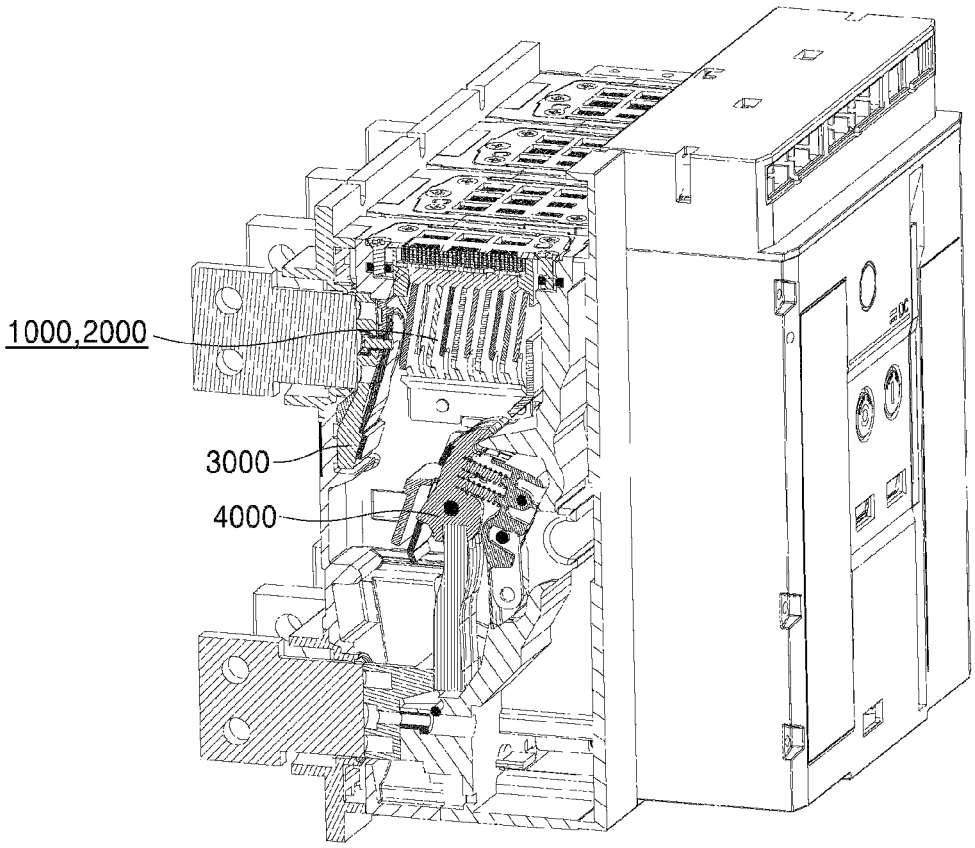
FIG. 7 is a block diagram schematically showing a direct-current air circuit breaker equipped with an arc-extinguishing structure according to the present disclosure.

FIG. 7 is a block diagram schematically showing a direct-current air circuit breaker having an arc-extinguishing structure according to the present disclosure.

As shown, the arc-extinguishing structure 1000 or 2000, a fixed conductor assay 3000 and a movable conductor assay 4000 are mounted on a body of the direct-current air circuit breaker.

Further, the movable conductor assay 4000 is mounted to face toward the fixed conductor assay 3000. The arc-extinguishing structure 1000 or 2000 is positioned above the fixed conductor assay 3000 and the movable conductor assay 4000 to extinguish the arc generated when the contacts are removed from each other.

Figure 8:
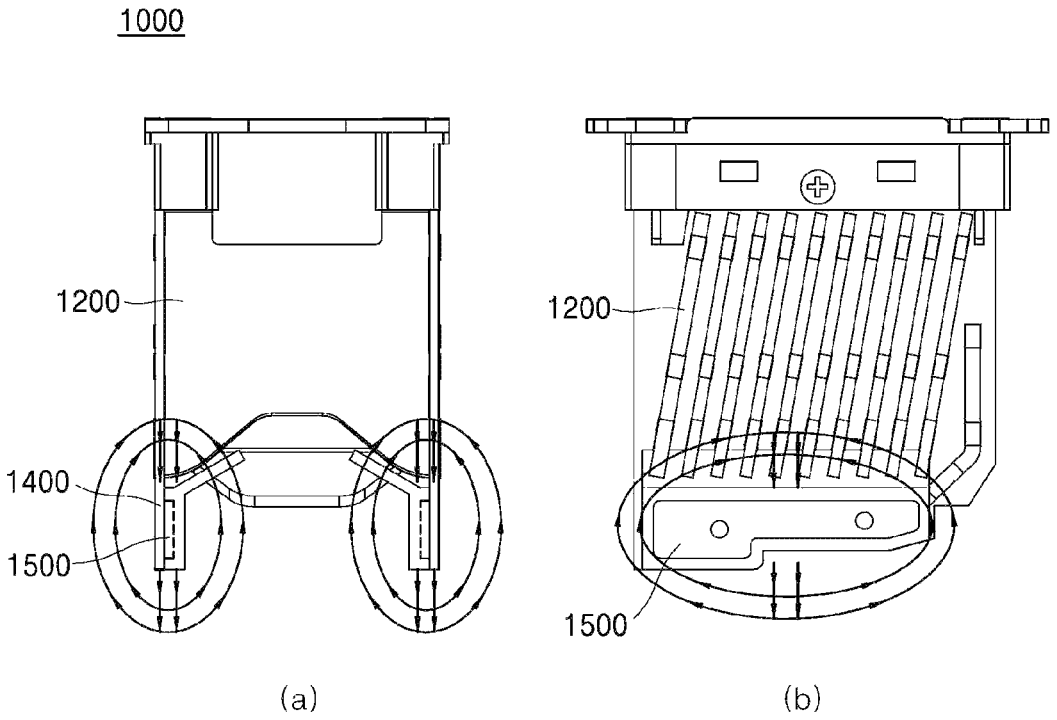
FIG. 8 is a schematic first use state diagram of the arc-extinguishing structure according to the first embodiment in the direct-current air circuit breaker shown in FIG. 7.
Figure 9:
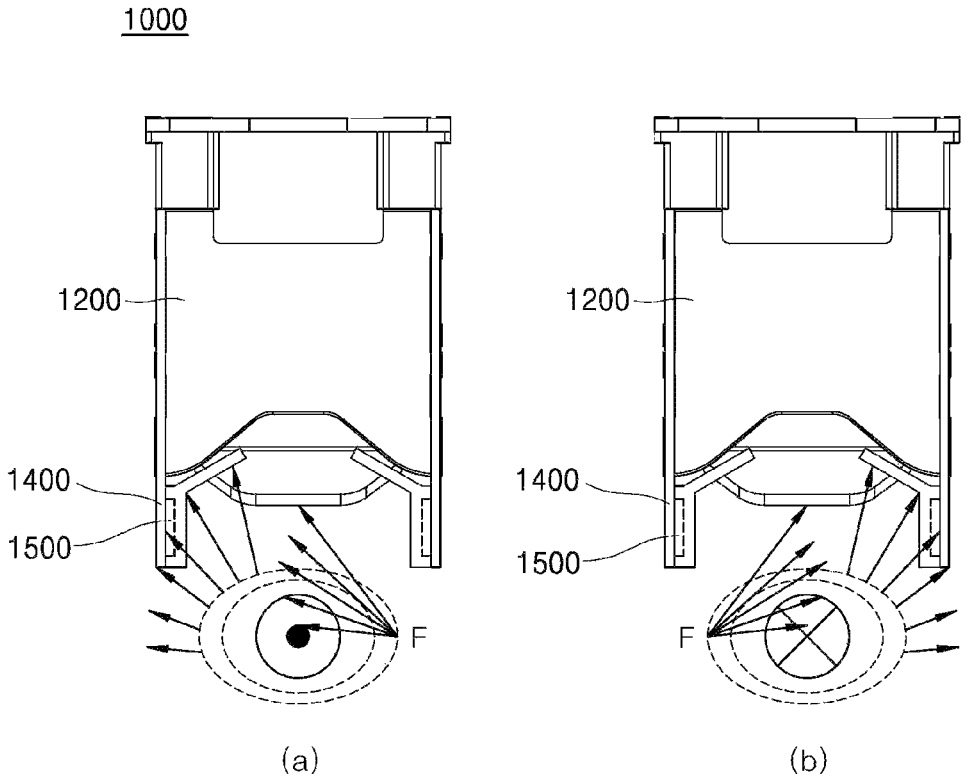
FIG. 9 is a schematic second use state diagram of the arc-extinguishing structure according to the first embodiment in the direct-current air circuit breaker shown in FIG. 7.

FIG. 8 is a schematic first use state diagram of the arc-extinguishing structure according to the first embodiment in the direct-current air circuit breaker shown in FIG. 7. FIG. 9 is a schematic second use state diagram of the arc-extinguishing structure according to the first embodiment in the direct-current air circuit breaker shown in FIG. 7.

As shown in FIG. 8, when the magnet 1500 is installed on the arc guide 1400, a magnetic field is distributed as shown by an arrow in small current interruption.

Further, when the direct-current air circuit breaker performs the small current interruption, the magnetic field is uniformly distributed around the magnet.

Further, as shown in FIG. 9, a magnitude of the arc magnetic field-based driving force is determined based on a magnetic field magnitude of the magnet, and a direction of the force is orthogonal to a direction of the magnetic field and a current direction.

That is, the arc magnetic field-based driving force F acts toward the grid 1200 as shown by an arrow, based on the magnetic field distribution and a connection direction of the small current. Further, (a) in FIG. 9 shows the driving force F when the current is output in an extension direction of the arc guide 1400, while (b) in FIG. 9 shows the driving force F when the current is input in the extension direction of the arc guide 1400.

Eventually, when the small current interruption occurs, the arc magnetic field-based driving force acts in a lateral direction of the grid 1200, based on the magnetic field distribution and the small current connection direction. as the arc magnetic field-based driving force F is generated in this way, not only arc extinguishing occurs quickly, but also arc backflow does not occur and arc stagnation does not occur.

Figure 10:
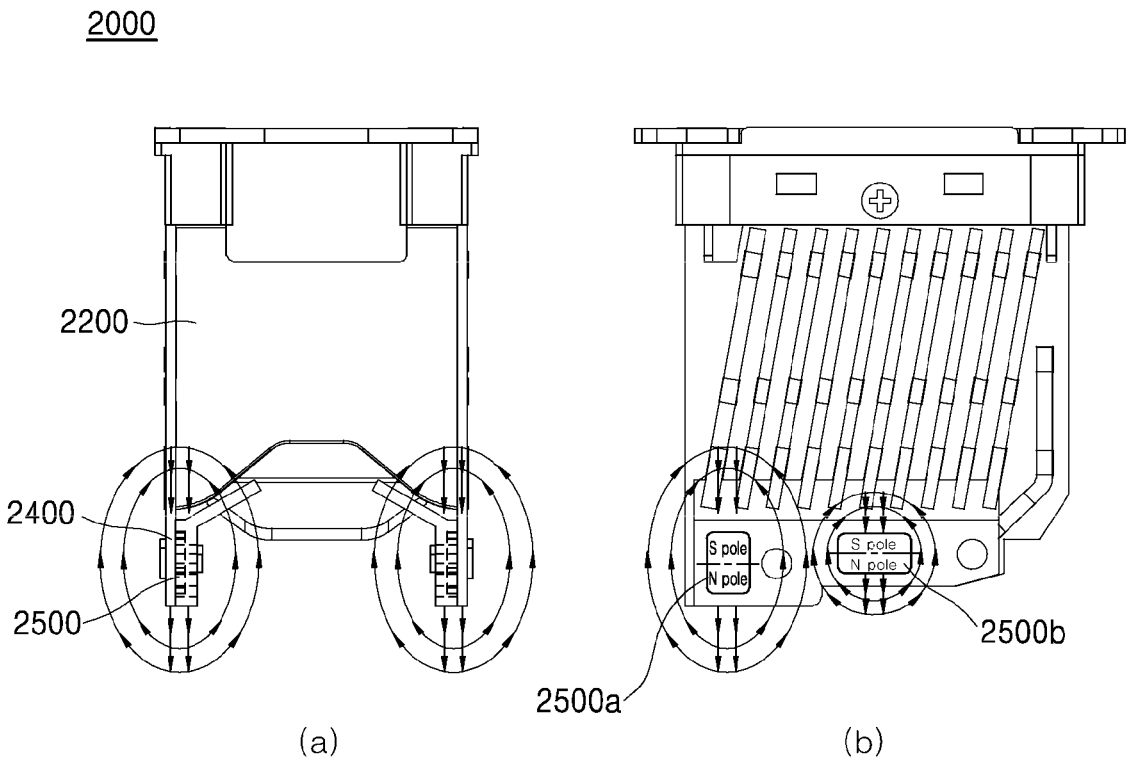
FIG. 10 is a schematic first use state diagram of the arc-extinguishing structure according to the second embodiment in the direct-current air circuit breaker shown in FIG. 7.
Figure 11:
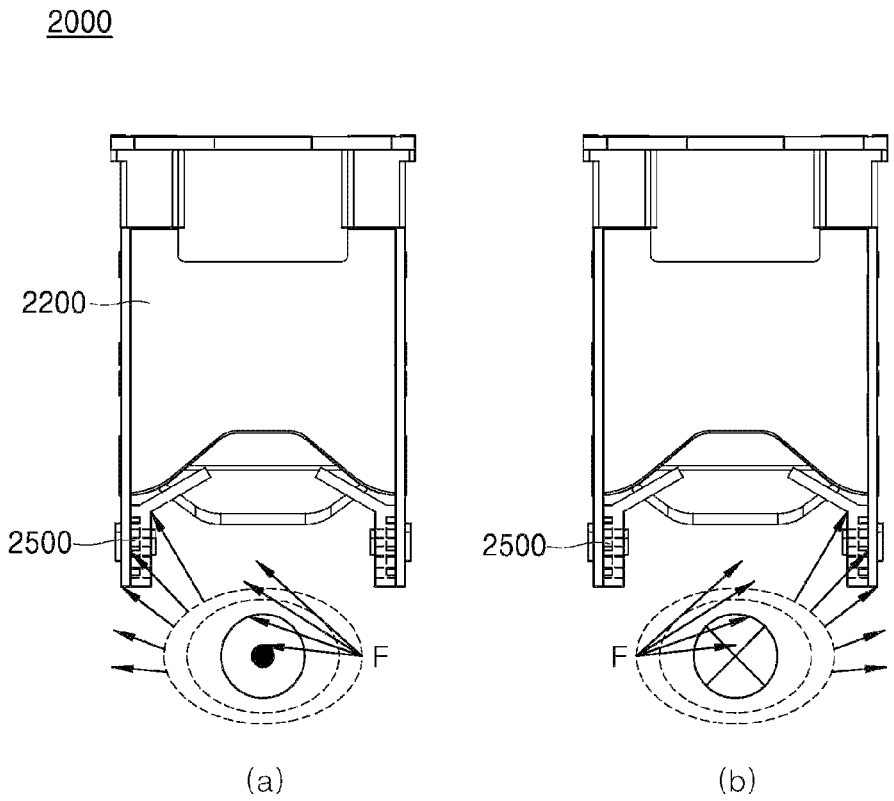
FIG. 11 is a schematic second use state diagram of the arc-extinguishing structure according to the second embodiment in the direct-current air circuit breaker shown in FIG. 7.

FIG. 10 is a schematic first use state diagram of the arc-extinguishing structure according to the second embodiment in the direct-current air circuit breaker shown in FIG. 7. FIG. 11 is a schematic second use state diagram of the arc-extinguishing structure according to the second embodiment in the direct-current air circuit breaker shown in FIG. 7.

As shown in FIG. 10, when the magnet 2500 is installed on the arc guide 2400, the magnetic field is distributed as shown in an arrow in the small current interruption.

Further, when the direct-current air circuit breaker performs the small current interruption, the magnetic field is uniformly distributed around the magnet.

Further, as shown in FIG. 11, a magnitude of the arc magnetic field-based driving force is determined based on a magnetic field magnitude of the magnet, and a direction of the force is orthogonal to a direction of the magnetic field and a current direction.

That is, the arc magnetic field-based driving force F acts toward the grid 2200 as shown by an arrow, based on the magnetic field distribution and a connection direction of the small current. Further, (a) in FIG. 11 shows the driving force F when the current is output in an extension direction of the arc guide 2400, while (b) in FIG. 11 shows the driving force F when the current is input in the extension direction of the arc guide 2400.

Eventually, when the small current interruption occurs, the arc magnetic field-based driving force acts in a lateral direction of the grid 2200, based on the magnetic field distribution and the small current connection direction. as the arc magnetic field-based driving force F is generated in this way, not only arc extinguishing occurs quickly, but also arc backflow does not occur and arc stagnation does not occur.

As described above, in both the arc-extinguishing structure 1000 according to the first embodiment of the present disclosure and the arc-extinguishing structure 2000 according to the second embodiment, the arc extinguishing may be achieved quickly, the arc backflow does not occur, and the arc stagnation does not occur. In the arc-extinguishing structure 2000, the magnet may have a maximum size to maximize the arc magnetic field-based driving force F. The arc-extinguishing structure 2000 may be easily installed regardless of the side plate fixing means 2430, and thus, assembly and productivity thereof may be improved.

Although the preferred embodiments of the present disclosure have been described with reference to the accompanying drawings, those of ordinary skill in the art to which the present disclosure pertains to the present disclosure will be understood that the disclosure may be embodied in specific forms without changing the technical idea or essential features of the disclosure. Therefore, it should be understood that the embodiment as described above is illustrative in all respects and not restrictive.

What is claimed is:

1. An arc-extinguishing structure for a direct-current air circuit breaker, the structure comprising:

a plurality of cooling plates;

a first and a second side plate, both opposing side plates respectively coupled to both opposing sides of each cooling plate of the plurality of cooling plates so that the plurality of cooling plates are stacked and spaced apart from each other;

a discharge cover positioned on top of the side plates and the plurality of cooling plates;

first and second arc guides, wherein each arc guide is respectively coupled to one of the side plates such that each arc guide is positioned below the plurality of cooling plates; and first and second magnets, wherein each magnet is coupled to one arc guide and wherein each magnet has upper and lower portions in a vertical arrangement of the plurality of cooling plates and the one arc guide, wherein the upper and lower portions have different poles, and wherein the upper portions for the first and second magnets have equivalent poles.

2. The arc-extinguishing structure of claim 1, wherein each arc guide defines a magnet receiving groove, wherein one magnet is received in the groove, wherein the one magnet extends in an arrangement direction of the plurality of cooling plates, wherein the magnet receiving groove extends in the arrangement direction of the plurality of cooling plates.

3. The arc-extinguishing structure of claim 2, wherein each cooling plate has a downwardly-inclined portion at a bottom of that cooling plate, wherein the downwardly-inclined portion has an inner side face inclined outwardly as the downwardly-inclined portion extends from a center toward each of both opposing ends, wherein each arc guide further includes a guide plate having an upwardly-inclined portion facing toward the downwardly-inclined portion.

4. The arc-extinguishing structure of claim 2, wherein a side plate fixing means is defined in each arc guide in an area of the magnet receiving groove, wherein an arc guide fixing means corresponding to the side plate fixing means is defined in the side plate.

5. The arc-extinguishing structure of claim 4, wherein each of the side plate fixing means and the arc guide fixing means is embodied as a through-hole.

6. The arc-extinguishing structure of claim 5, wherein the first magnet extends in a longitudinal direction of the first arc guide, and a mounting hole corresponding to the through-hole is defined in the first magnet, wherein a fastener fastens the arc guide fixing means, the mounting hole, and the side plate fixing means to each other, wherein the fastener fastens the first arc guide to the first side plate while the first magnet is received in a corresponding magnet receiving groove.

7. The arc-extinguishing structure of claim 2, wherein the upper portion of each magnet is magnetized as a S pole and the lower portion thereof is magnetized as an N pole.

8. The arc-extinguishing structure of claim 2, wherein a guide plate of each arc guide in which the magnet receiving groove is defined is formed such that a dimension of one side of the guide plate is larger than a dimension of an opposite side thereof, wherein a dimension of one side of the magnet receiving groove is larger than a dimension of an opposite side thereof, wherein a dimension of one side of the magnet coupled to the magnet receiving hole is larger than a dimension of an opposite side thereof.

9. The arc-extinguishing structure of claim 8, wherein the upper portion of each magnet is magnetized as a S pole and the lower portion thereof is magnetized as an N pole.

10. The arc-extinguishing structure of claim 1, wherein each arc guide has a plurality of magnet receiving grooves for receiving a plurality of the magnets, wherein a side plate fixing means is defined in each arc guide in an area of each of the magnet receiving grooves, wherein an arc guide fixing means corresponding to the side plate fixing means is defined in the side plate.

11. The arc-extinguishing structure of claim 10, wherein each of the side plate fixing means and the arc guide fixing means is embodied as a through-hole.

12. The arc-extinguishing structure of claim 11, wherein a fastener fastens the arc guide fixing means and the side plate fixing means to each other, wherein the fastener fastens the arc guide to the side plate while the magnet is received in the magnet receiving groove.

13. The arc-extinguishing structure of claim 10, wherein each arc guide extends in a longitudinal direction from one side to an opposite side thereof and, further, extends downwards from one side, wherein the magnet receiving groove includes a first magnet receiving groove extending downwards from one side of the arc guide, and a second magnet receiving groove extending from one side of the arc guide to the opposite side thereof, wherein the magnet includes a first magnet extending downwards in a corresponding manner to the first magnet receiving groove, and a second magnet extending in the longitudinal direction in a corresponding manner to the second magnet receiving groove.

14. The arc-extinguishing structure of claim 10, wherein the each cooling plate has a downwardly-inclined portion at a bottom of that cooling plate, wherein the downwardly-inclined portion has an inner side face inclined outwardly as the downwardly-inclined portion extends from a center toward each of both opposing ends, wherein the arc guide further includes a guide plate having an upwardly-inclined portion facing toward the downwardly-inclined portion.

15. The arc-extinguishing structure of claim 1, wherein a movement trajectory of a movable contact associated with the arc-extinguishing structure and a direction of magnetization of the first and second magnets are orthogonal to each other.

16. An arc-extinguishing structure for a direct-current air circuit breaker, the structure comprising:

a first side plate;

a second side plate;

a discharge cover connected to the first side plate to the second side plate;

a first arc guide connected to the first side plate on an end opposite to where the discharge cover is connected;

a second arc guide connected to the second side plate on the end opposite to where the discharge cover is connected;

a plurality of cooling plates evenly spaced apart from one another, wherein each cooling plate is connected to a first side of the first side plate and a second side of the second side plate, parallel to the first side, between the discharge cover and the first arc guide and the second arc guide;

a first magnet coupled to the first arc guide and the first side of the first side plate; and a second magnet coupled to the second arc guide and the second side of the second side plate, wherein each of the first magnet and the second magnet are oriented with a first pole separated from a second pole in a polarity plane that is perpendicular to the first side and the second side to have the first pole on a shared side of the polarity plane with one another.

17. The arc-extinguishing structure of claim 16, wherein a movement trajectory of a movable contact associated with the arc-extinguishing structure and a direction of magnetization of the first and second magnets are orthogonal to each other.

* * * * *